US007794370B2

(12) United States Patent
Tackett

(10) Patent No.: US 7,794,370 B2
(45) Date of Patent: Sep. 14, 2010

(54) EXERCISE UNIT AND SYSTEM UTILIZING MIDI SIGNALS

(76) Inventor: Joseph A Tackett, 613 Leyland Ct., Lake Orion, MI (US) 48362

( * ) Notice: Subject to any disclaimer, the term of this patent is extended or adjusted under 35 U.S.C. 154(b) by 1319 days.

(21) Appl. No.: 11/168,167

(22) Filed: Jun. 28, 2005

(65) Prior Publication Data

US 2005/0288159 A1 Dec. 29, 2005

Related U.S. Application Data

(60) Provisional application No. 60/583,937, filed on Jun. 29, 2004.

(51) Int. Cl.
*A63B 71/00* (2006.01)

(52) U.S. Cl. ..... 482/83; 482/8

(58) Field of Classification Search ..... 482/48–90; 84/645

See application file for complete search history.

(56) References Cited

U.S. PATENT DOCUMENTS

| | | | | |
|---|---|---|---|---|
| 3,933,354 | A | 1/1976 | Goldfarb et al. | |
| 4,088,315 | A | 5/1978 | Schemmel | |
| 4,534,557 | A | 8/1985 | Bigelow et al. | |
| 4,627,620 | A | 12/1986 | Yang | |
| 4,702,475 | A | 10/1987 | Elstein et al. | |
| 4,720,789 | A | 1/1988 | Hector et al. | |
| 4,761,005 | A | 8/1988 | French et al. | |
| 4,824,107 | A | 4/1989 | French | |
| 4,883,271 | A | 11/1989 | French | |
| 4,974,833 | A | 12/1990 | Hartman et al. | |
| 5,099,702 | A | 3/1992 | French | |
| 5,137,501 | A | 8/1992 | Mertesdorf | |
| 5,213,503 | A | 5/1993 | Marshall et al. | |
| 5,215,463 | A | 6/1993 | Marshall et al. | |
| 5,221,243 | A | 6/1993 | Walker | |
| 5,262,585 | A * | 11/1993 | Greene et al. | 84/645 |
| 5,271,627 | A | 12/1993 | Russell et al. | |
| 5,469,740 | A | 11/1995 | French et al. | |
| 5,553,860 | A | 9/1996 | Zelikovich | |
| 5,899,809 | A | 5/1999 | Landa Cosio | |
| 5,901,961 | A | 5/1999 | Holland, III | |

(Continued)

FOREIGN PATENT DOCUMENTS

| | | | |
|---|---|---|---|
| EP | 1159989 | A1 | 12/2001 |

(Continued)

*Primary Examiner*—Jerome Donnelly
(74) *Attorney, Agent, or Firm*—Howard & Howard Attorneys PLLC

(57) ABSTRACT

An exercise unit (20) and system (104) comprising a target (22) having at least one area (24) to be struck by a user and at least one sensor (26) located at the area (24) is disclosed. The sensor (26) generates an electrical signal in response to being struck by the user. A processor (48) is in operative communication with the sensor (26) and a musical instrument digital interface (MIDI) converter (50) is disposed between the sensor (26) and the processor (48). The MIDI converter (50) converts the electrical signal from the sensor (26) to a MIDI signal and transmits the MIDI signal to the processor (48) for generating a MIDI strike track (52). The MIDI strike track (52) is used to determine an accuracy and a force of the strike by the user to provide interaction and feedback to the user to continue to help motivate the user.

15 Claims, 7 Drawing Sheets

U.S. PATENT DOCUMENTS

| | | | | |
|---|---|---|---|---|
| 6,056,671 | A | 5/2000 | Marmer | |
| 6,088,733 | A | 7/2000 | Kikuchi | |
| 6,110,079 | A | 8/2000 | Luedke et al. | |
| 6,336,891 | B1 | 1/2002 | Fedrigon et al. | |
| 6,417,435 | B2 | 7/2002 | Chantzis et al. | |
| 6,600,097 | B2 | 7/2003 | Shiiya | |
| 2003/0073541 | A1 | 4/2003 | Carlson | |
| 2003/0181290 | A1 | 9/2003 | Black | |
| 2003/0221545 | A1 * | 12/2003 | Tomoda | 84/723 |
| 2004/0058787 | A1 | 3/2004 | Lin | |
| 2005/0266967 | A1 * | 12/2005 | Considine et al. | 482/84 |

FOREIGN PATENT DOCUMENTS

| | | |
|---|---|---|
| WO | WO 00/52678 | 9/2000 |

* cited by examiner

EXERCISE UNIT AND SYSTEM UTILIZING MIDI SIGNALS

CROSS REFERENCE TO RELATED APPLICATION

This application claims the benefit of U.S. Provisional Patent Application Ser. No. 60/583,937 filed Jun. 29, 2004.

BACKGROUND OF THE INVENTION

1. Field of the Invention

The subject invention provides an exercise unit and system that utilizes musical instrument digital interface (MIDI) signals to facilitate a workout routine. The subject invention also provides a method of utilizing these MIDI signals to facilitate the workout routine.

2. Description of the Prior Art

Various exercise units and systems are known to one of ordinary skill in the art and these units and systems include a target having at least one area to be struck by a user and at least one sensor located at the area for detecting the strike. These sensors may be connected to various display units for indicating an amount of force delivered by the strike and an accuracy of the strike relative to the area to be struck. Another type of exercise unit includes specialized hardware to implement switching between various areas to be struck by the user.

However, these exercise units do not provide adequate interaction or feedback with the user to continue to motivate the user or ensure that the user will continue to workout. Further, the specialized hardware is expensive and difficult to maintain when exposed to the repetitive stresses that occur during the workout routine and when exposed to the caustic environment that is generally encountered during a workout routine.

Further, sensors that are more robust have been used to monitor performance of different exercise units, such as bikes, elliptical trainers, tread mills, stair climbers, and the like. These sensors are built to withstand repetitive motions or stresses and caustic environments. However, these sensors tend to be expensive and the exercise units do not provide adequate interaction or feedback to motivate the user.

SUMMARY OF THE INVENTION AND ADVANTAGES

The subject invention provides an exercise unit comprising a target having at least one area to be struck by a user and at least one sensor located at the area to be struck. The sensor is associated with a unique identifier and generates an electrical signal in response to the force of the user striking the area. The sensor is in operative communication with a processor and a musical instrument digital interface (MIDI) converter. The MIDI converter is disposed between the sensor and the processor to convert the electrical signal from the sensor to a MIDI signal representing a location of the strike based upon the unique identifier and representing a force of the strike by the user. The MIDI signal is transmitted to the processor for generating a MIDI strike track. An exercise system is also provided linking a plurality of these exercise units to one another. The exercise units are linked by a communication network for allowing the user to perform workout routines on successive exercise units.

The subject invention further provides a method of facilitating a workout routine. The method comprises generating an electrical signal from at least one sensor associated with a unique identifier in response a user striking an area adjacent the sensor on a target and converting the electrical signal from the sensor to a musical instrument digital interface (MIDI) signal with a MIDI converter. Next, the location of the strike on the target is detected based upon the unique identifier of the sensor generating the electrical signal, and the MIDI signal is transmitted to a processor to generate a MIDI strike track corresponding to each strike by the user.

The subject invention provides an exercise unit and system that provide high levels of interaction and feedback to the user to continue to motivate the user. Further, the subject invention makes the workout routine more fun by providing the feedback, while also teaching potentially lifesaving defensive skills. The exercise unit does not require specialized hardware thereby reducing the manufacturing cost and the exercise unit is able to withstand repetitive stresses.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
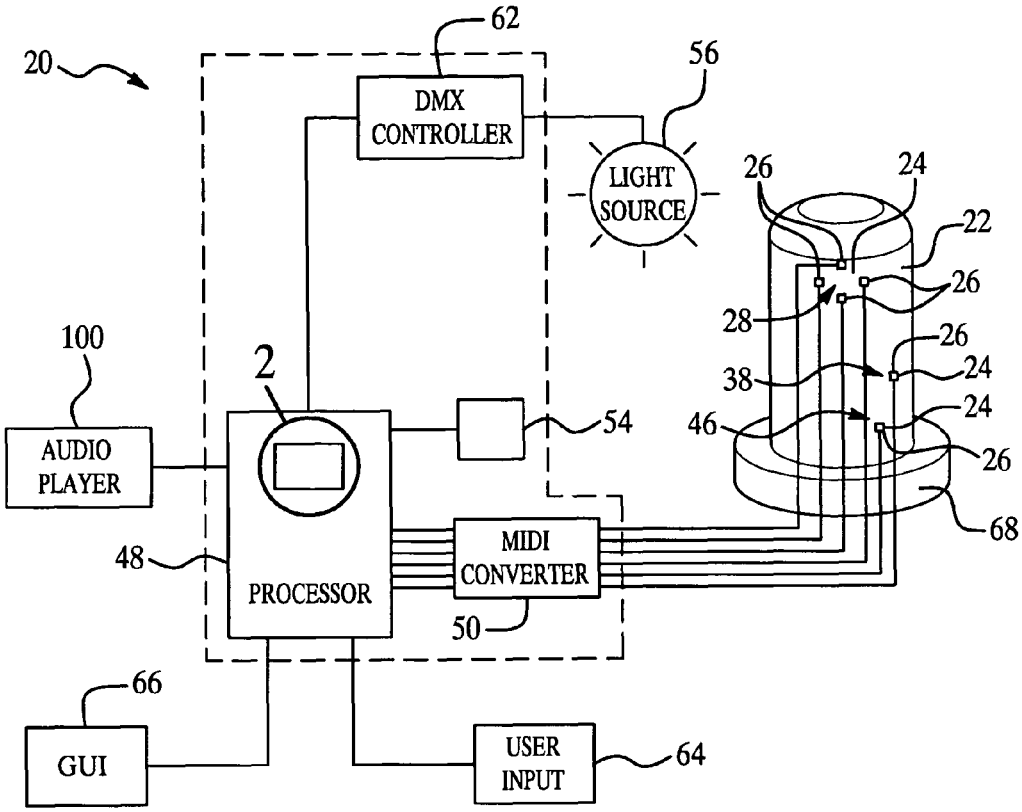
FIG. 1 is a schematic view of one embodiment of an exercise unit that utilizes musical instrument digital interface (MIDI) signals to facilitate to a workout routine.

Referring to the Figures, wherein like numerals indicate corresponding parts throughout the several views, an exercise unit is shown generally at 20 in FIG. 1. The exercise unit 20 generally comprises a target 22 having at least one area 24 to be struck by a user and at least one sensor 26 located at the area 24. The area 24 to be struck may generally correspond to potential areas of an attacker. For example, the areas 24 may include a nose area 28, a right temple area 30, a left temple area 32, a solar plexus area 34, a right rib area 36, a left rib area 38, a stomach area 40, a groin area 42, a right knee area 44, and a left knee area 46. The type of strike may include a punch, a kick, or a block and each may be further defined, such as a closed fist punch, a flat palm punch, a roundhouse kick, a knee, or the like. Each strike may be further defined by an approach of the user to deliver the strike, such as front approach, round house, side approach, or the like.

The embodiment of the exercise unit 20 illustrated in FIG. 1 includes the target 22 being generally bag-shaped and having the nose area 28, the left rib area 38, and the left knee area 46. It is to be appreciated that additional areas may be included in the target 22. A plurality of sensors 26 may be located at each area 24 such that each of the sensors 26 are associated with an identifier different from one another. As another example, each area 24 to be struck may include three to five sensors. For example, the nose area 28 includes four sensors 26 positioned in a diamond shape. Whereas, only one sensor 26 is located at the left rib area 38 and one sensor 26 is located at the left knee area 46. Each of the sensors 26 generates an electrical signal in response to the force of the user striking the area 24. Further, since each sensor 26 is associated with the identifier, the electrical signal from each of the sensors 26 can be used to determine an accuracy of the strike. The subject invention provides for multiple different identifiers such that the nose area 28 identifier may be different from the left knee identifier and each of the four nose area sensors 26 also has different identifiers. The unique identifier may be hard coded into the sensors 26 or implemented in software as would be understood by one of ordinary skill in the art.

The exercise unit 20 further includes a processor 48 in operative communication with the sensor 26 and a musical instrument digital interface (MIDI) converter 50 disposed between the sensor 26 and the processor 48. It is to be appreciated that the MIDI converter 50 may be based in software or as a separate hardware device. Further, the MIDI converter 50 may include additional components, without being limited thereto, such as oscillators, filters, and the like. The MIDI converter 50 has multiple channels for connecting to the plurality of sensors 26 and for detecting the identifiers. For example, the four nose area sensors may connect to channels 1 to 4, the left rib sensor is connected to channel 5, and the left knee sensor is connected to channel 6.

The MIDI converter 50 converts the electrical signal from the sensor 26 to a MIDI signal. The MIDI signal includes a location of the strike based upon the unique identifier and a force of the strike by the user. The MIDI signal is then transmitted to the processor 48 for generating a MIDI strike track 52. The electrical signals may be transmitted between the sensors 26, the MIDI converter 50, and the processor 48 via hard wires or wirelessly, such as by RF signals or Bluetooth signals. When the user strikes the nose area 28, each of the four sensors 26 would generate the electrical signal. If the strike were centered perfectly between each of the sensor 26, the current of the electrical signal would be identical from each. However, if the strike were off-center, such as towards the left sensor, the left sensor would generate a larger current than the right sensor. The same result would occur for the upper and lower sensors. The MIDI strike track 52 reflects the current of the electrical signals which allows the processor 48 determine the accuracy and force of the strike. For example, the processor 48 may access a database 54 having the sensor 26 configuration at each area 24 stored therein. Additionally, the database 54 may include the amount of current that may be generated by each sensor 26 and the required force to generate the current. For example, each area 24 may be subjected to a known force and the current is measured and stored in the database as a look-up table. The force would then be applied at various positions about the area 24 to measure the current at each sensor to be used to determine the accuracy. Alternatively, the force may be determined in real time by employing other software programs as understood by those of ordinary skill in the art.

The sensors 26 are preferably MIDI sensors and one type of MIDI sensors that are particularly useful with the subject invention is piezoelectric-type MIDI sensors. As understood by those of ordinary skill in the art, piezoelectric-type MIDI sensors utilize a crystallized material that generates an electric current when a force, or pressure, is applied to the material. The larger the force applied, then the larger the electric current that is generated. Another type of piezoelectric sensor 26 that is particularly useful with the subject invention is available in a coaxial cable. Multiple sections of the coaxial cable would surround the areas 24 to be struck, such as in a rectangular shape, so that each section the coaxial cable would be subjected to the force of the strike. Each of the sections may receive a different amount of the force that is utilized to determine the accuracy and force of the strike. It is to be appreciated by one of ordinary skill in the art that other sensors than those described above may work with the subject invention.

The exercise unit 20 may further include a light source 56 for illuminating the area 24 to be struck by the user. The light source 56 may be formed internally within the target 22 or positioned outside the target 22 for directing a beam of light onto the area 24 to be struck. For example, the light source 56 may include light emitting diodes inside the target 22. In addition to indicating the area 24 to be struck, the light source 56 may also indicate the type of strike and the type of approach. For example, a blue light may indicate a punch, a yellow light may indicate a block, and a red light may indicate a kick. Further, a square shape may indicate a front approach, a circle shape may indicate a roundhouse, or a triangle shape may indicate a side approach. One example of a suitable intelligent light source is a DJ Scan 250.

The light source 56 may further be defined as MIDI-compatible and in operative communication with the processor 48. The processor 48 directs the light source 56 to illuminate the area 24 via a MIDI light track 60. The MIDI light track 60 includes MIDI data and/or MIDI commands from the processor 48. It is to be understood that MIDI-compatible is intended to mean that the light source 56 is responsive to the MIDI light track 60 from the processor 48. The light source 56 may be able to directly receive and respond to the MIDI light track 60 or convert the MIDI light track 60 to another format. For example, a digital multiplexing (DMX) controller 62 may be in operative communication with the processor 48 and the light source 56 for converting the MIDI light track 60.

As an example, the MIDI light track 60 may include four channels for directing the light source 56. The MIDI light track 60 may include first and second MIDI data, or values, representing coordinates for the area 24 to be struck and third and fourth MIDI data representing a type of strike to be performed by the user. Said another way, the first channel may represent an amount of rotation about an X-axis (pan) and the second channel may represent an amount of rotation about a Y-axis (tilt). The first and second channels would then indicate the target 22 to be struck on the exercise unit 20. The third channel may represent the color of the light to be emitted and the fourth channel may represent the shape. The light source 56 may receive the MIDI light track 60 having channel 1 to 4 and respond accordingly. Alternatively, the MIDI light track 60 may be converted into a corresponding DMX format by the DMX controller 62.

The following table illustrates the data for the MIDI light track 60 that would correspond to each area 24 to be struck. As appreciated by those of ordinary skill in the MIDI art, the MIDI data are generally reported as a velocity and the value ranges from 0 to 128. Channels 1 and 2 are the pan and tilt, respectively, channel 3 is the color, and channel 4 is the shape. It is to be appreciated that the color and shape may be different depending upon the workout routine.

TABLE 1

MIDI Light Track Coordinates

| Area to be Struck | 1 | 2 | 3 | 4 |
|---|---|---|---|---|
| Right Temple | 60 | 127 | 62 | 3 |
| Left Temple | 90 | 127 | 32 | 3 |
| Nose Bone | 70 | 127 | 22 | 36 |
| Solar Plexus | 70 | 99 | 22 | 3 |
| Stomach | 70 | 74 | 22 | 36 |
| Groin | 70 | 49 | 22 | 3 |
| Right Knee | 60 | 24 | 62 | 3 |
| Left Knee | 90 | 24 | 32 | 3 |

The exercise unit 20 may further include a user input 64 in operative communication with the processor 48 for inputting information relating to the user. For example, the user input 64 may include a card swipe such that the user is able to swipe an identification card. The processor 48 logs and tracks workout routines performed by the user and provides valuable analysis of the workout routines. A graphical user interface 66 (GUI) may also be used to display the results of the workout routine to the user and provides feedback in real time to the user.

Figure 2A:
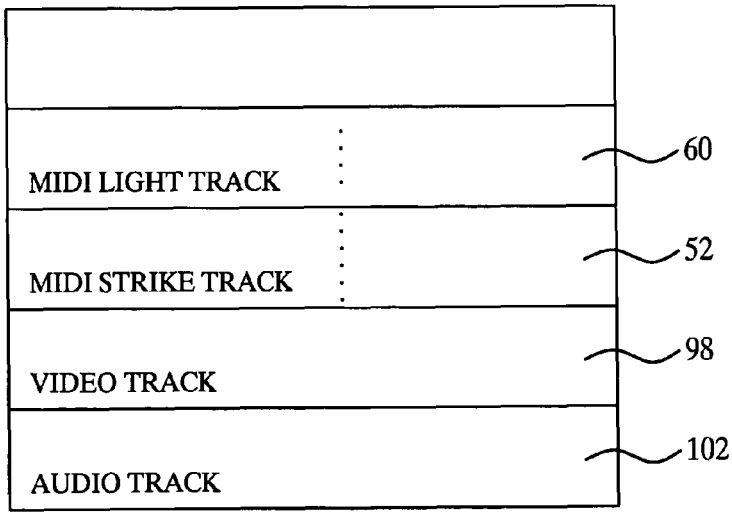
FIG. 2A is a graphical representation of MIDI data that is generated by the exercise unit as a result of the exercise routine.
Figure 2B:
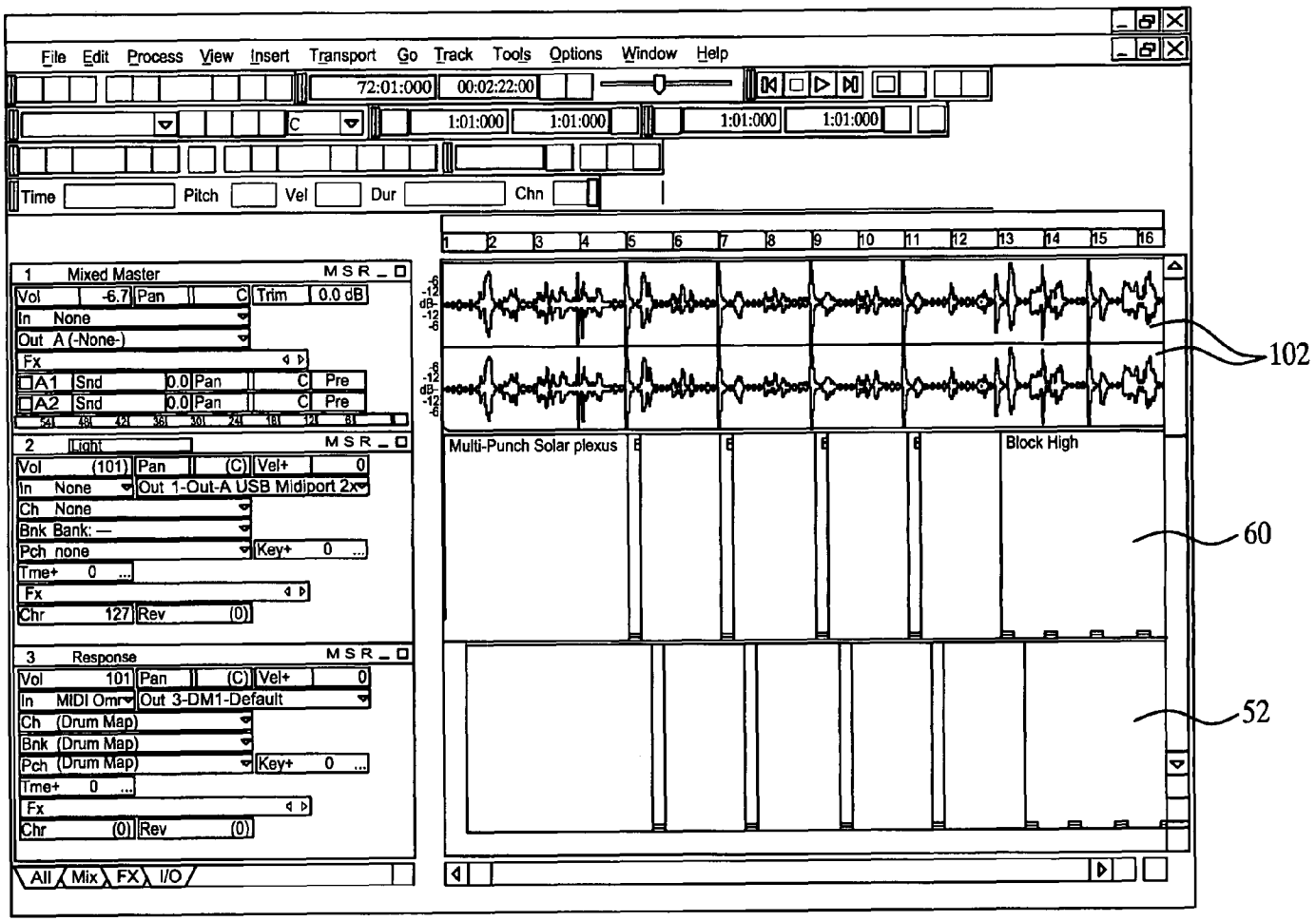
FIG. 2B is a graphical representation of a software program having the MIDI data and for generating the workout routine.

FIG. 2 is a graphical representation of MIDI data, or values, that are generated by the exercise unit 20. Once the user completes the workout routine, the process may compare the MIDI light track 60 and the MIDI strike track 52 to determine a reaction time for the user. The reaction time can be determined for all targets 22 during the entire workout routine or each target 22 can be isolated from the workout routine. Further, the reaction time for specific types of strikes and approaches may be determined by comparing the MIDI light track 60 and MIDI strike track 52. FIG. 2B is a graphical representation of a software program for developing the workout routine and for capturing the MIDI strike track. Examples of suitable software programs are Sonar Virtual Recording Studio and Protools.

Referring back to FIG. 1, the processor 48, the MIDI converter 50, and the DMX controller 62 are illustrated as being housed within a stand-alone unit, such as a personal computer, represented by dashed lines. However, the MIDI converter 50 and/or the DMX controller 62 may be housed separately from the processor 48 or from one another. For example, the MIDI converter 50 may be a stand-alone device that connects to the personal computer. Alternatively, each of the processor 48, the MIDI converter 50, and the DMX controller 62 may be connected to one another via a wired or wireless network. Additionally, the processor 48 and the MIDI converter 50 may be housed directly in the target 22, such as in the base, or may be housed within the base of the light source 56.

Figure 3:
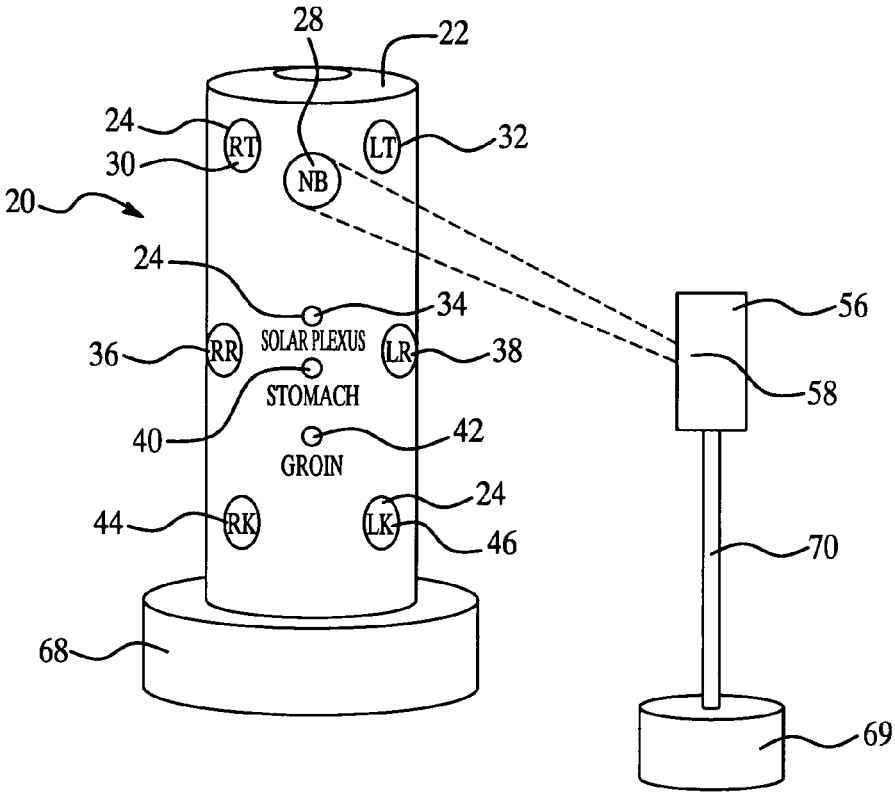
FIG. 3 is a perspective view of another embodiment of the exercise unit.

FIG. 3 is another embodiment of the exercise unit 20 having the target 22 with a plurality of areas 24 to be struck. A base 68 supports the target 22 in an upright position. The target 22 may further be moveable on the base 68 to control the movement of the target 22, such as having the target 22 avoid or attack the user. In addition to the nose area 28, the left rib area 38, and the left knee area 46, the exercise unit 20 includes the right and left temple areas 30, 32, the right rib 36 and knee area 44, as well as solar plexus, stomach, and groin areas 34, 40, 42. The light source 56 is positioned adjacent the target 22 and has a base 69, a light support 70, and a light 58. As described above, the processor 48, the MIDI converter 50, and the DMX controller 62 may be housed in either the base 68 of the target 22 or the base 69 of the light source 56.

Figure 4:
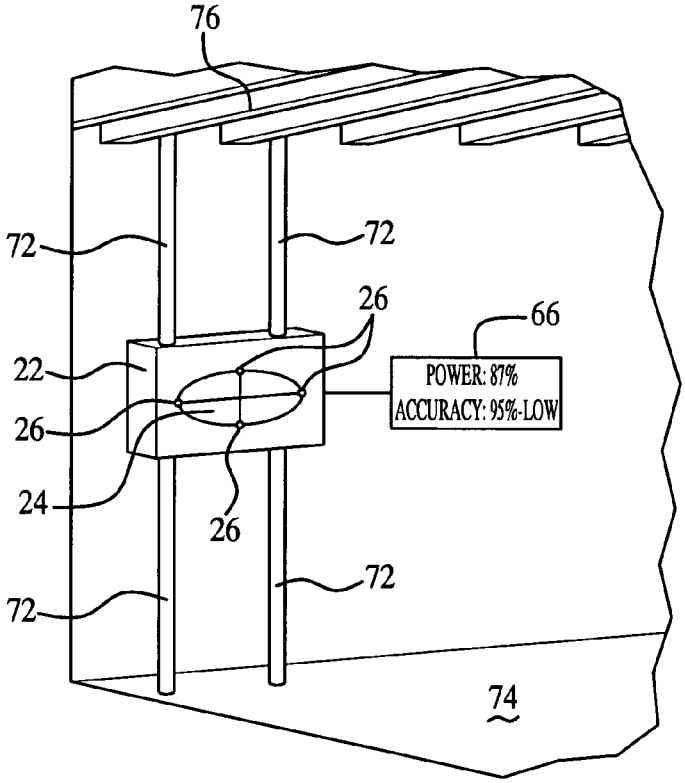
FIG. 4 is a perspective view of yet another embodiment of the exercise unit.

With reference to FIG. 4, yet another embodiment of the exercise unit 20 is illustrated. The exercise unit 20 includes the target 22 having only one area 24 to be struck and the GUI 66 to display the results of the strike. The processor 48 and MIDI converter 50 may be housed in either the target 22 or the GUI 66. In this embodiment, the light source 56 is not utilized since there is only one area 24 to strike. The exercise unit 20 may be supported by rods 72 to allow the exercise unit 20 to be moveable to adjust to the height of the user. The rods 72 may be suspended between a floor 74 and a ceiling 76 or be mounted on a moveable base (not shown). Preferably, the rods 72 include flexible supports, such as springs, to flex and recoil when the target 22 is struck. The GUI 66 displays the power of the strike and the accuracy. As discussed above with regard to the nose area 28, this embodiment includes the plurality of sensors 26 or the coaxial cable sensors arranged in a rectangle shape to determine the accuracy and force of the strike.

Figure 5:
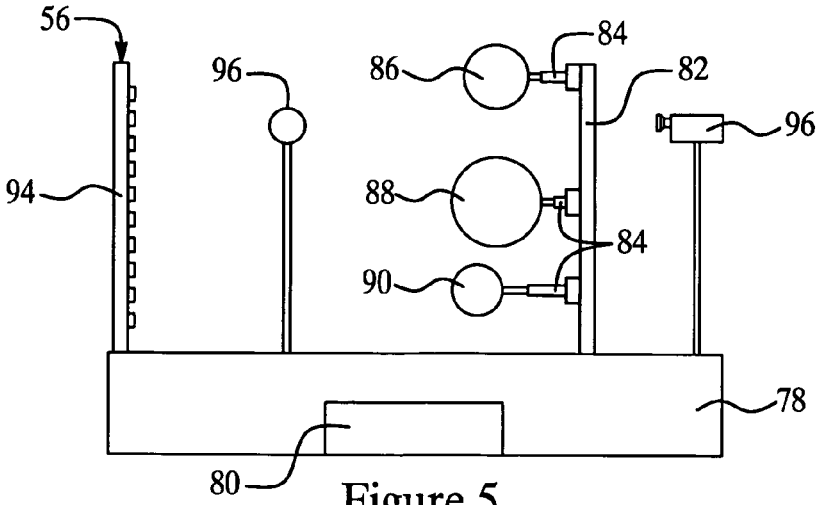
FIG. 5 is a side view of still another embodiment of the exercise unit.
Figure 6:
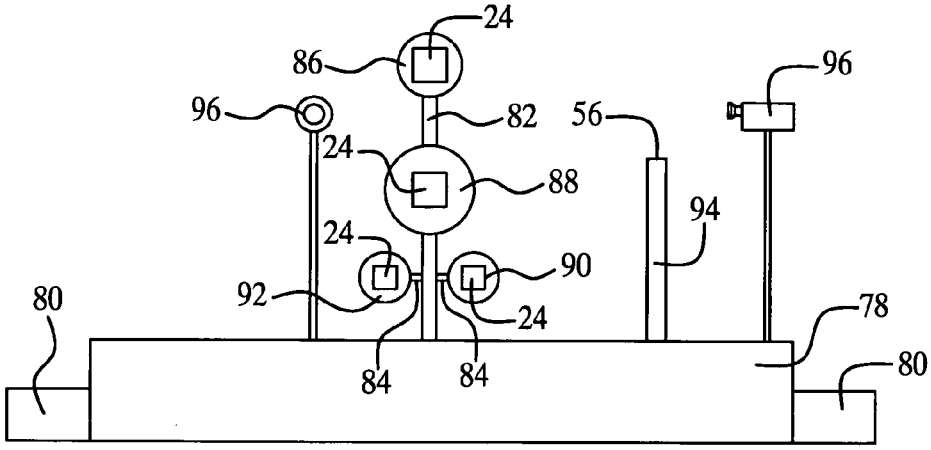
FIG. 6 is a front view of the exercise unit illustrated in FIG. 5.
Figure 7:
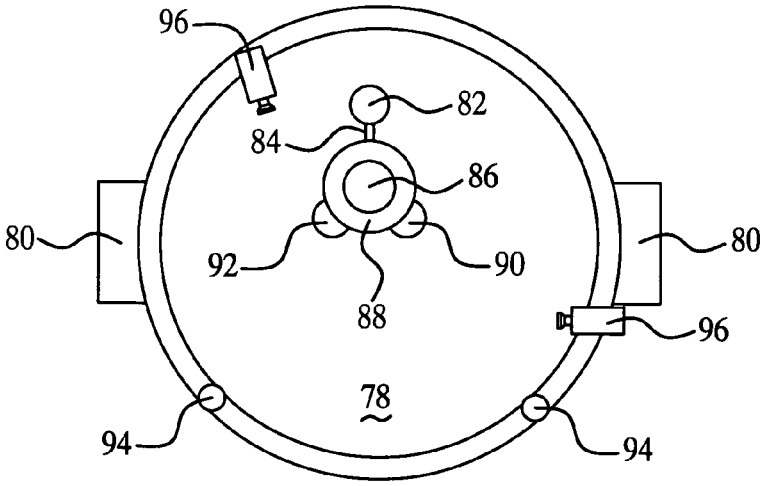
FIG. 7 is a top view of the exercise unit illustrated in FIG. 5.

FIGS. 5 to 7 illustrate still another embodiment of the subject invention. The exercise unit 20 includes a raised platform 78 having four different targets 22 positioned similar to the vital areas 24 of an attacker. Steps 80 may be positioned adjacent the raised platform 78 to assist the user in entering and exiting the exercise unit 20. The targets 22 are supported by a pole 82 and support arms 84 that are flexible to allow the targets 22 to recoil, pivot, or swivel in any direction. The four targets 22 generally correspond to a head target 86, a midsection target 88, and left and right knee targets 90, 92 and each of the targets 22 has at least one area 24 to be struck. The light source 56 is illustrated as a spot light array 94 positioned adjacent the targets 22. The processor 48, MIDI converter 50, and DMX controller 62, if present, may be housed apart from the embodiment shown in FIG. 5 or housed within the raised platform 78.

The exercise unit 20 also includes a camera 96 positioned adjacent the targets 22. FIG. 7 is a top view of the exercise unit 20 having a front camera and a side camera. The camera 96 may synchronize with the processor 48 for recording the user striking the area 24 and for creating a video track 98. The video track 98 allows the user to obtain real time feed back by displaying the video track 98 upon completion of the workout routine. The video track 98 may also be displayed in the GUI 66 allowing the user to slow down playback to study the strikes. The video track 98 may be digital or analog, however, it is preferred that the video track 98 be captured digitally for synchronization by the processor 48.

The exercise unit 20 also includes an audio player 100 in operative communication with the processor 48 for playing an audio track 102 synchronized with the MIDI light track 60. The audio player 100 is preferably a software based player, however, it may also include a stand-alone device. The audio track 102 may include a music track and/or a vocal track. Further, the music track and the vocal track may each be separate and distinct audio tracks 102. The music track has an upbeat tempo to encourage the user during the workout routine, such as between 100 and 130 beats per minute. The vocal track may be used to provide instructions to the user prior to or during the workout routine. Once the workout routine is complete, the video track 98 is synchronized with the audio track 102 to allow the user to have a copy of the workout routine, such as on a videocassette, a compact disc, or a digital video disc.

Figure 8:
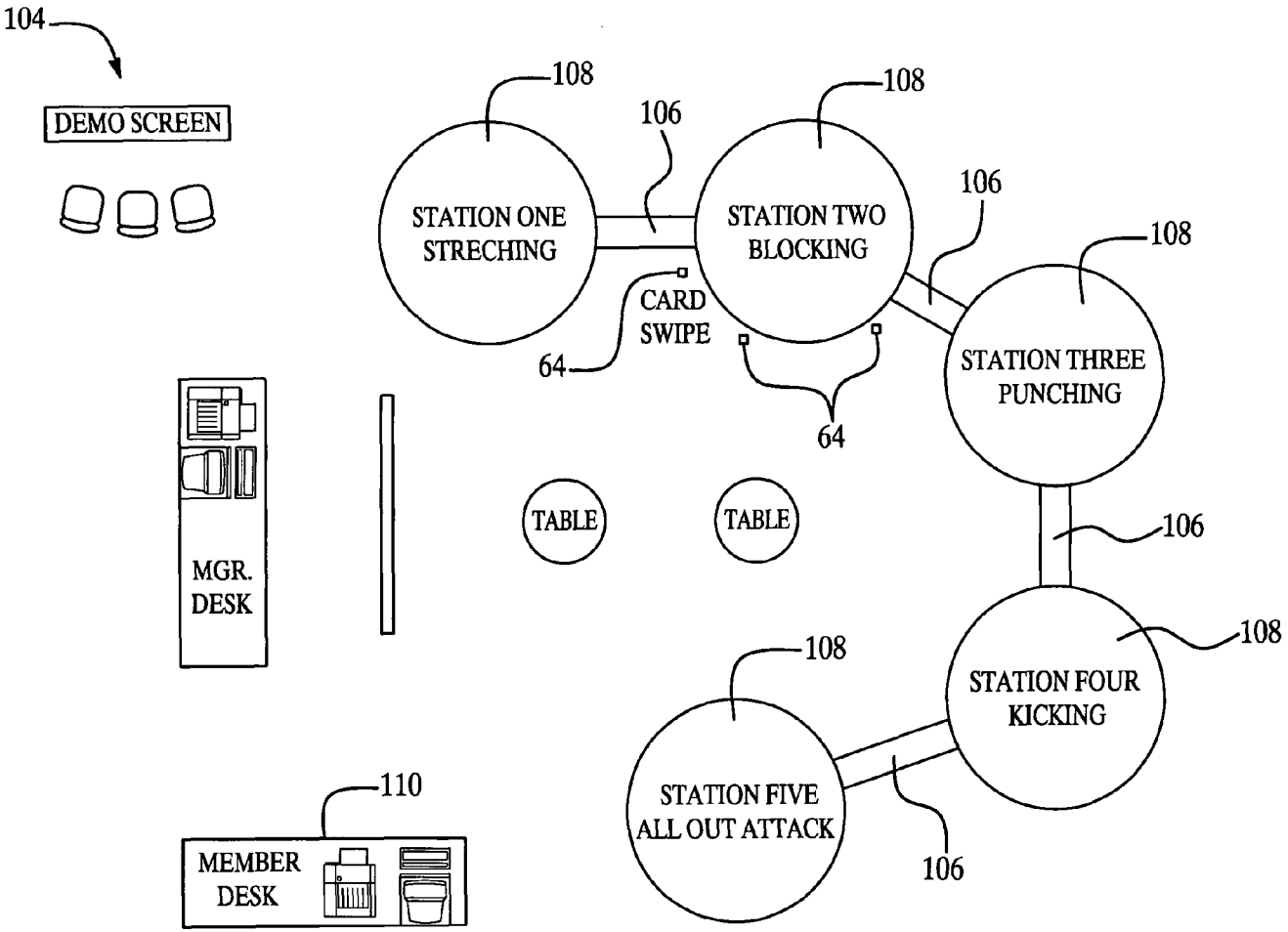
FIG. 8 is a schematic view of an exercise system linking a plurality of exercise units to one another.

FIG. 8 illustrates a schematic view of an exercise system 104 that comprises a plurality of exercise units 20 linked together by a communication network 106 representing multiple workout stations 108. The exercise system 104 allows the user to perform workout routines on successive exercise units 20 at each of the stations 108. The stations 108 may include a stretching station, a blocking station, a punching station, a kicking station, and an all-out-attack station. Each station 108 may include the exercise units 20 shown and described in any of the above embodiments. In this manner, circuit type training may be employed whereby the user must complete each station 108 in a predetermined time. The circuit type training may include 5 minute workout routines at each station 108.

The exercise system 104 can track the workout routines and determine the progress that the user is making. As the user enters one station 108, the identification card is swiped into the exercise unit 20. The processor 48 may determine the type, length, and difficulty of the workout routine for the user or the user may select it through the GUI 66. At the completion of the first station, the user exits the first station and proceeds to the second station. The user may then swipe the identification card at the second station to alert the exercise system 104 that the user is ready to begin the second station. In this manner, the user is able to rest in between stations 108. Alternatively, the exercise system 104 may allot a predetermined amount of time in between stations 108 for the user to rest, whereby the next station 108 will automatically start. This allows the exercise system 104 to determine how far behind the user is in the workout routine. Further, the exercise system 104 can be used in a competitive nature allowing users from across the globe to compete against one another for a high proficiency or score.

The subject invention further provides a method of facilitating a workout routine. The method comprises generating the electrical signal from at least one sensor 26 associated with the unique identifier in response the user striking the area adjacent the sensor 26 on the target 22 and converting the electrical signal from the sensor 26 to the MIDI signal with the MIDI converter 50. The location of the strike on the target 22 is detected based upon the unique identifier of the sensor 26 generating the electrical signal. As described above, the force of each strike is determined based upon the electrical signal.

Figure 9:
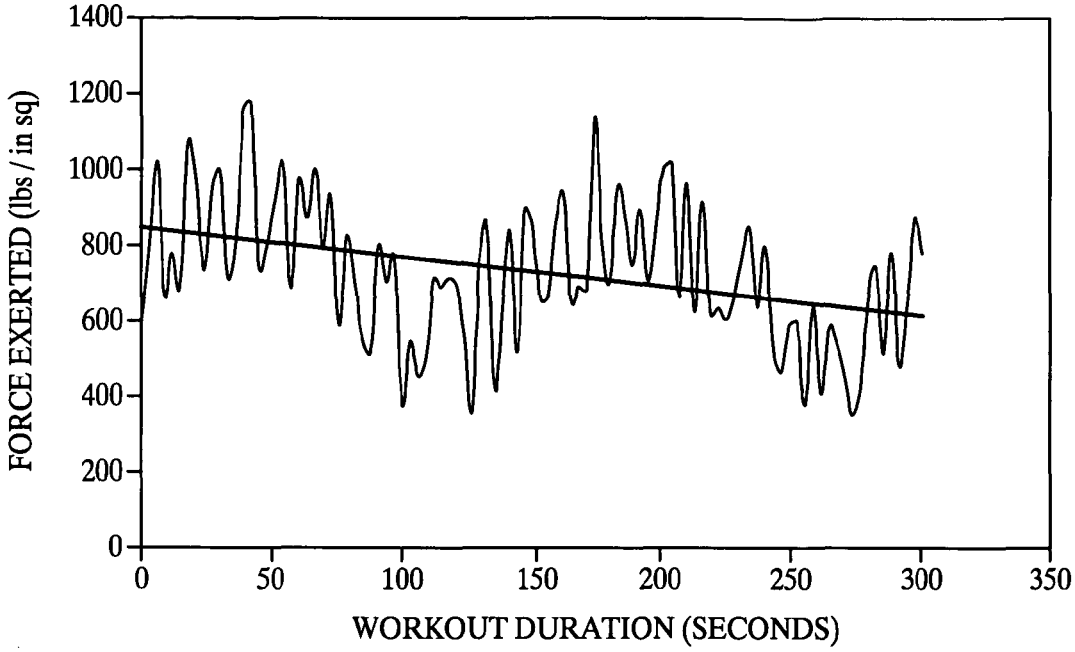
FIG. 9 is a graphical representation of an overall force of the strikes by the user during the workout routine.

The MIDI signal is transmitted to the processor 48 to generate the MIDI strike track 52 corresponding to each strike. FIG. 9 is a graphical representation of the overall force exerted with each strike during the workout routine, which is based upon the MIDI strike track 52. The workout routine was 300 seconds, or 5 minutes, and included different types of strikes at different areas. From the graph, the amount of force of each strike was between about 300 to about 1200 pounds per square inch. A trend line may be added to illustrate the force of the user as the workout routine progressed, which in this case, the force declined during the workout routine.

Figure 10:
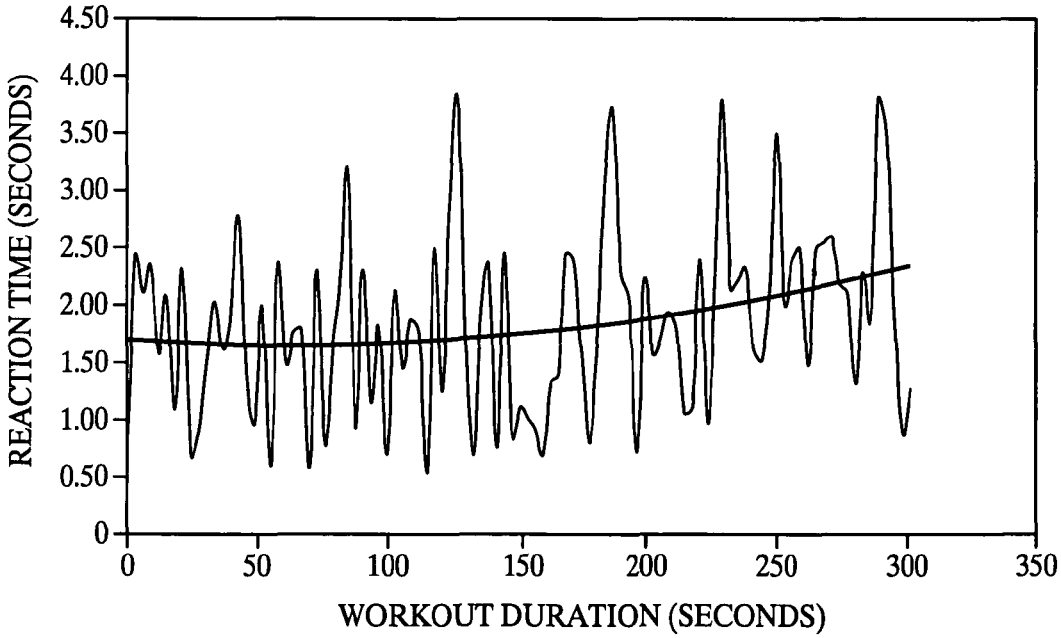
FIG. 10 is a graphical representation of an overall reaction time for each of the strikes to various targets during the workout routine.

The processor 48 directs the light source 56 to illuminate the area 24 on the target 22 with the MIDI light track 60. Once the workout is complete, or after the user has struck the target 22, the MIDI light track 60 and the MIDI strike track 52 are compared to determine a response time of the user. FIG. 10 is a graphical representation of the overall reaction time for the workout routine, which is based upon the comparison of the MIDI light track 60 and the MIDI strike track 52. A trend line may also be added to illustrate the reaction time over the course of the workout routine. The trend line in FIG. 10 illustrates that the user reacted more quickly towards the end of the workout routine than at the beginning.

Figure 11:
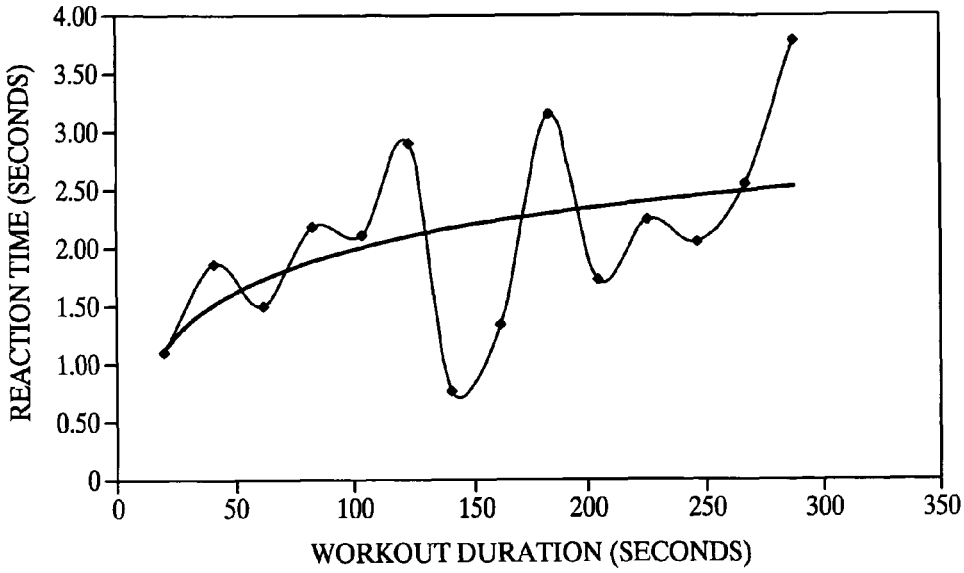
FIG. 11 is a graphical representation of a stomach reaction time for each of the strikes to a stomach area during the workout routine.

FIG. 11 is a graphical representation of the reaction time of strikes directed toward the stomach area 40 that occurred during the workout routine. The type of strike and approach may have included any of the types described above. For example, the first time the stomach area 40 was indicated for striking was at about 15 seconds. The reaction time for the user was about 1.1 seconds. The next time the stomach area 40 was indicated was at about 45 seconds and the user had a reaction time of about 1.9 seconds. A trend line is illustrated to show that the reaction time of the user became slower as the workout routine progressed.

Figure 12:
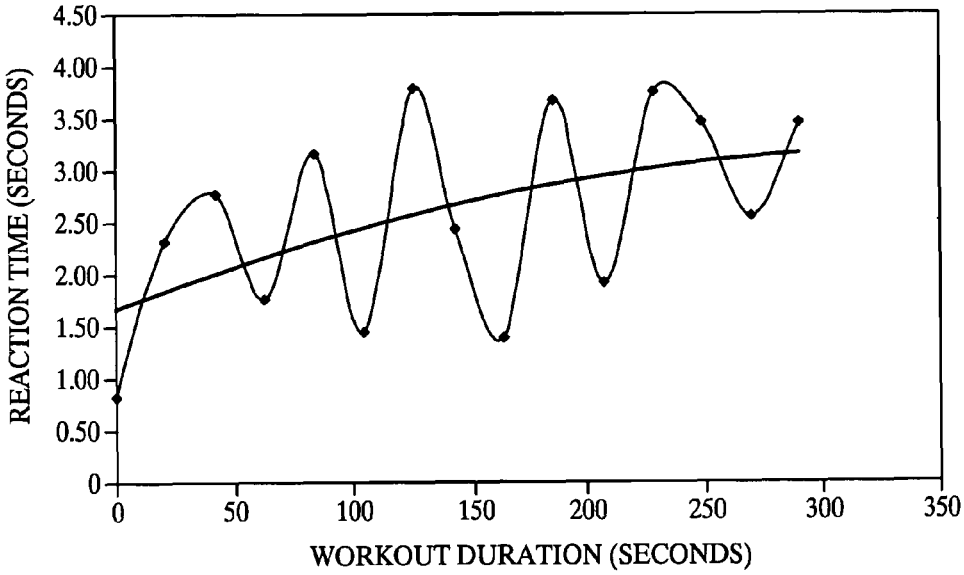
FIG. 12 is a graphical representation of a nose reaction time for each of the strikes to a nose area during the workout routine.

FIG. 12 is a graphical representation of the reaction time of strikes directed toward the nose area 28 that occurred during the workout routine. The type of strike and approach may have included any of the types described above. For example, the first time the nose area 28 was indicated for striking was at the beginning of the workout routine and the response time was about 0.8 seconds. The next nose area 28 strike was at about 20 seconds and the reaction time for the user was about 2.4 seconds. The next time the nose area 28 was indicated was at about 50 seconds and the user had a reaction time of about 2.8 seconds. A trend line is illustrated to show that the reaction time of the user become slower as the workout routine progressed.

Various graphical representations can be made, such as for each area 24 to be struck and for the type of strike and approach since such data is available in the MIDI light track 60. The comparison of the MIDI light track 60 and the MIDI strike track 52 allows for virtually unlimited data reports to monitor and improve during the workout routine and during successive workout routines. In other words, the subject invention is able to determine whether the user hit the right target 22, what was the reaction time of the strike, how accurate was the strike, and what amount of power was delivered by the strike. A report station 110 is available at the end of the system to allow the user to obtain such reports of the workout routine.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, the reference numerals in the claims are merely for convenience and are not to be read in any way as limiting.

What is claimed is:

1. An exercise unit (20) comprising:

a target (22) having at least one area (24) to be struck by a user;

a plurality of sensors (26) located at said area (24) and each of said sensors (26) associated with a unique identifier for generating an electrical signal in response to a force of the user striking the area (24) and each of said sensors (26) being different from one another for detecting an accuracy of the strike by the user;

a light source (56) for illuminating said area (24) of a portion of said target (22) to be struck by said user;

a processor (48) in operative communication with said sensors (26) and in operative communication with said light source (56), said processor (48) capable of generating a musical instrument digital interface (MIDI) light track (60) and communicating said MIDI light track (60) to said light source (56) such that said light source (56) is responsive to said MIDI light track (60) for illuminating said area (24); and a musical instrument digital interface (MIDI) converter (50) disposed between said sensors (26) and said processor (48) to convert said electrical signal from said sensors (26) to a MIDI signal representing a location of the strike based upon said unique identifier and representing a force of the strike by the user and transmitting said MIDI signal to said processor (48) for generating a MIDI strike track (52).

2. An exercise unit (20) as set forth in claim 1 wherein said sensors (26) are further defined as MIDI sensors.

3. An exercise unit (20) as set forth in claim 2 wherein said MIDI sensors (26) are further defined as piezoelectric-type MIDI sensors.

4. An exercise unit (20) as set forth in claim 1 further comprising a digital multiplexing controller (62) in operative communication with said processor (48) and said light source (56) for converting said MIDI light track (60) into said area (24) to be struck.

5. An exercise unit (20) as set forth in claim 1 wherein said MIDI light track (60) further comprises first and second MIDI values representing coordinates for said area (24) to be struck.

6. An exercise unit (20) as set forth in claim 5 wherein said MIDI light track (60) further comprises third and fourth MIDI values representing a type of strike to be performed by the user.

7. An exercise unit (20) as set forth in claim 1 further comprising an audio player (100) in operative communication with said processor (48) for playing an audio track (102) synchronized with said MIDI light track (60).

8. An exercise unit (20) as set forth in claim 1 further comprising a camera (96) synchronized with said processor (48) for recording the user striking said area (24) and for creating a video track (98).

9. An exercise unit (20) as set forth in claim 1 further comprising a plurality of targets (22) such that each of said targets (22) have at least one area (24) to be struck.

10. An exercise unit (20) as set forth in claim 1 further comprising a user input (64) in operative communication with said processor (48) for inputting information relating to the user.

11. An exercise system (104) comprising:

a plurality of exercise units (20);

each of said exercise units (20) comprise a target (22) having at least one area (24) to be struck by a user and at least one sensor (26) located at said area (24) associated with a unique identifier for generating an electrical signal in response to a force of the user striking the area (24);

a light source (56) for each of said exercise units (20) for illuminating said area (24) of a portion of said target (22) to be struck by said user;

a processor (48) in operative communication with said light source (56), said processor (48) capable of generating a musical instrument digital interface (MIDI) light track (60) and communicating said MIDI light track (60) to said light source (56) such that said light source (56) is responsive to said MIDI light track (60) for illuminating said area (24);

a musical instrument digital interface (MIDI) converter (50) receiving electrical signals from said exercise units (20) and converting said electrical signals into MIDI signals representing a location of the strike based upon said unique identifier and representing a force of the strike by the user and transmitting said MIDI signal to said processor (48) for generating a MIDI strike track (52); and a communication network (106) interconnecting each of exercise units (20) for allowing the user to perform workout routines on successive exercise units (20).

12. An exercise system (104) as set forth in claim 11 wherein each of said exercise units (20) further comprise a plurality of sensors (26) located at said area (24) and each of said sensors (26) associated with a unique identifier different from one another for detecting an accuracy of the strike by the user.

13. An exercise system (104) as set forth in claim 12 wherein said sensors (26) are further defined as MIDI sensors.

14. An exercise system (104) as set forth in claim 11 wherein each of said exercise units (20) are further defined as having a processor (48) and a MIDI converter (50) disposed within each of said exercise units (20).

15. An exercise unit (20) as set forth in claim 1 wherein said processor compares said MIDI light track (60) and said MIDI strike track (52) for determining a response time of the user.

* * * * *